US008974308B2

(12) United States Patent
Boss et al.

(10) Patent No.: US 8,974,308 B2
(45) Date of Patent: Mar. 10, 2015

(54) SYSTEM AND METHOD FOR GAMING TRANSACTIONS

(75) Inventors: Gregory J. Boss, American Fork, UT (US); Rick A. Hamilton, II, Charlottesville, VA (US); Kevin C. McConnell, Austin, TX (US); James W. Seaman, Falls Church, VA (US)

(73) Assignee: International Business Machines Corporation, Armonk, NY (US)

( * ) Notice: Subject to any disclaimer, the term of this patent is extended or adjusted under 35 U.S.C. 154(b) by 2354 days.

(21) Appl. No.: 11/015,494

(22) Filed: Dec. 17, 2004

(65) Prior Publication Data

US 2006/0135260 A1 Jun. 22, 2006

(51) Int. Cl.
*A63F 9/24* (2006.01)
*G07F 17/32* (2006.01)

(52) U.S. Cl.
CPC ..... *G07F 17/32* (2013.01); *G07F 17/3223* (2013.01); *G07F 17/3255* (2013.01)
USPC ..... 463/43; 463/7; 463/9; 463/29; 463/40; 463/41; 463/42

(58) Field of Classification Search
USPC ..... 463/7, 9, 29, 39–43
See application file for complete search history.

(56) References Cited

U.S. PATENT DOCUMENTS 5,390,934 A * 2/1995 Grassa ..... 273/292
6,264,555 B1 7/2001 Glazman et al.
6,264,560 B1 * 7/2001 Goldberg et al. ..... 463/42
6,685,565 B2 * 2/2004 Tanibuchi et al. ..... 463/31
2002/0068592 A1 6/2002 Hutcheson et al.
2002/0173359 A1 11/2002 Gallo et al.
2003/0032474 A1 2/2003 Kaminkow
2003/0032476 A1 2/2003 Walker et al.
2003/0125104 A1 7/2003 Walker et al.
2003/0211889 A1 11/2003 Walker et al.
2003/0229893 A1 12/2003 Sgaraglino
2004/0015608 A1 1/2004 Ellis et al.
2004/0024666 A1 2/2004 Walker et al.
2004/0048671 A1 3/2004 Rowe
2006/0030407 A1 * 2/2006 Thayer ..... 463/42

OTHER PUBLICATIONS

Linden Research Inc, Second Life, Jun. 23, 2003, Wikipedia http://en.wikipedia.org/wiki/Second_Life.*
Linden Research Inc, Second Life, Jun. 23, 2003, Wikipedia, Economy of Second Life http://en.wikipedia.org/wiki/Economy_of_Second_Life.*
Linden Research Inc, Second Life, Jun. 23, 2003 http://www.cat.ilstu.edu/downloads/pdf/secondLife/Second_Life_Starter_Guide.pdf.*

* cited by examiner

*Primary Examiner* — Sunit Pandya
(74) *Attorney, Agent, or Firm* — Matthew Chung; Roberts Mlotkowski Safran & Cole, P.C

(57) ABSTRACT

A method and system is provided to tie role-driven gaming purchases to executable transactions during a game so that on-line or related gaming systems create economic value inside the game itself. Players may control characters within a game which uses money to exchange goods or services to reach a goal, accomplish a task, or succeed in an event. The invention also provides for a participant to enter a game as a service provider to other players wherein the player receives compensation for the service. The service may be to provide aid in the form of a character or to provide educational services, for example. Accounts may be created to accumulate winnings or earnings as games are played.

27 Claims, 3 Drawing Sheets

SYSTEM AND METHOD FOR GAMING TRANSACTIONS

FIELD OF THE INVENTION

The invention generally relates to a system and method for charging fees in role-driven games and, more particularly, to a system and method for acquiring revenue from role-driven opportunities during a game.

BACKGROUND DESCRIPTION

The vast majority of electronic games today involve a purchasing model where the player buys the rights to play a game, often indefinitely, for a lump sum of money. At that point, the player may play the game as often as they wish without incurring any more costs. Some players play the purchased game for a few hours, some for hundreds of hours and others will play it for thousands of hours. In all cases, the gaming company derives their revenue purely from the initial sale. The disadvantages with this is that those players who really enjoy the game, may very likely pay more for the gaming opportunity and, accordingly, this may be viewed as lost revenue potential for the gaming company. This may include both single and multi-player games.

In games today, generating revenue on behalf of the player does not exist. Games do not provide an opportunity for players to accrue financial pools of money for their own benefit. Role-driven games do not consider involving financial achievement as part of the role-drive game itself.

Other variations of gaming models include a smaller (though significant) lump sum charge along side an additional monthly fee for use during that month. These are often MMOG, or Massively Multi-player On-line Game. Others are just multi-player games. In this model, the player interacts with other human opponents or partners, and in order to do for any given month, they must pay a monthly fee. This model becomes slightly more desirable than the previous in that the maker of the game obtains not only a base revenue, but also a recurring revenue stream according to the continued interest level of the consumer. This model's disadvantage is that there is only binary correlation between the player's interest and the revenue earned in a monthly cycle. Either the customer has or has not paid, and therefore, value any individual might be willing to pay is still irrelevant. Rather, the game's manufacturer is left to estimate the game's economic elasticity. Thus, the manufacturer must try to maximize revenue based on the model of each player as a binary "yes/no" payer, setting the subscription price according to their estimates.

SUMMARY OF THE INVENTION

In an aspect of the invention, a method is provided for gaming. The method comprises the steps of participating in a game by selecting one or more game roles and accumulating an account entry in an account of a user based upon the selected one or more roles and accompanying activity.

In another aspect of the invention, a system for gaming is provided. The system comprises a means for participating in a game by selecting one or more game roles and a means for accumulating an account entry in an account of a user based upon the selected one or more roles and accompanying activity.

In another aspect of the invention, a computer program product is provided comprising a computer usable medium having readable program code embodied in the medium and includes a first computer program code, the computer program product includes at least one component to participate in a game by selecting one or more game roles and accumulate an account entry in an account of a user based upon the selected one or more roles and accompanying activity.

DETAILED DESCRIPTION OF EMBODIMENTS OF THE INVENTION

This invention is directed to a system and method for tying role-driven gaming purchases to executable transactions during the game. The invention extends enhancements to on-line gaming systems and provides a business model that extends an economically rational behavior inside the game, itself. The players control characters within a game which uses money to exchange goods and services to reach a goal, accomplish a task, or succeed in an event, and optionally receive prizes. This invention addresses creating an enticing virtual world where individuals/players may have an opportunity to earn and spend real money, while the hosting gaming company may make an optimized profit off of all transactions occurring during game play.

In the system and method of the invention, it may typically cost nothing for a player to get started in the game, but money may be spent to become better educated, acquire items, participate in activities, or the like. In general, the more a player spends, the better their chances of succeeding. As the player progresses in the game, and becomes more active, more money may be required to enter advanced levels. Therefore, the more the player spends on education and supplies increases their chances to win the game allowing them to earn money rather than loose money.

Optionally, of course, nominal one-time or monthly subscriptions may still be maintained; however, within the model of the invention, incentives may now exist for a player to continue spending over-and-above any other optional one-time or standing fees. A few advantages, among others, of the invention may include:

- An increase in revenue to the maker/provider of the game; and
- A possibility for the customer, or player, to participate in a game that may be less expensive than a "normal" priced game or, if the player is good enough, they may be able to make money.

In each case above, both the consumer and the supplier of the game may receive additional benefits when compared to previous game playing models. Many players may not be as skilled or fortunate and may "lose" more money than others.

Figure 1:
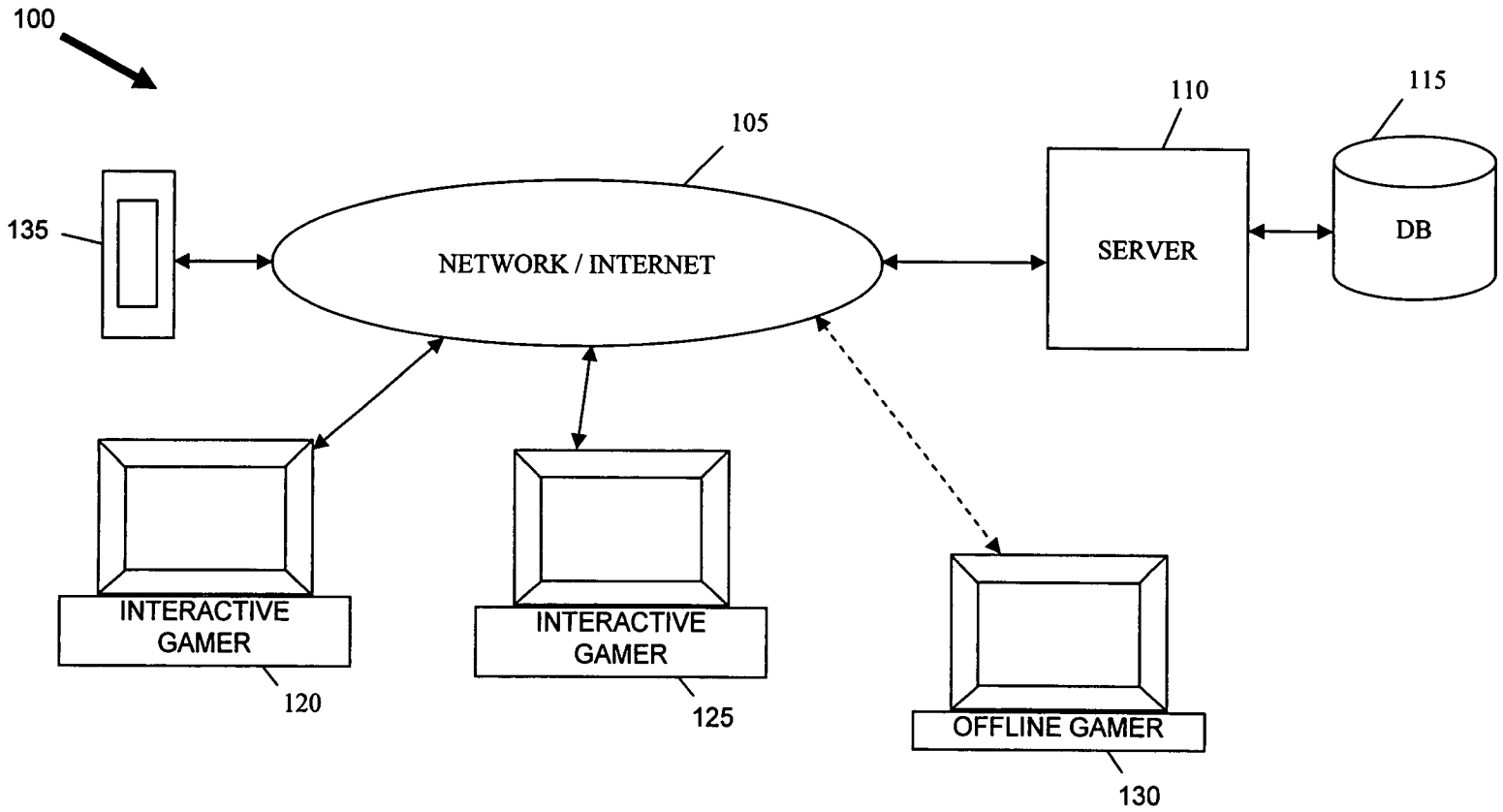
FIG. 1 is a block diagram of an embodiment of the invention.

FIG. 1 is a block diagram of an embodiment of the invention, generally denoted by reference numerical 100. The invention includes a network 105 (e.g., the Internet), a server 110 for running (or delivering for off-line mode) one or more interactive games, a database 115 for storing information associated with the one or more games, and one or more interactive gamers 120 and 125. The interactive gamers 120 and 125 are interactively connected to the server 110 via the network 105. Off-line gamers 130 may periodically log on to the server 110 via the network 105 to acquire new games or advance in status in a current game. The invention may also include a device such as a personal digital assistant 135 (or alternatively a cell phone, or the like) for interactively playing games provided by server 110 over network 105.

Figure 2:
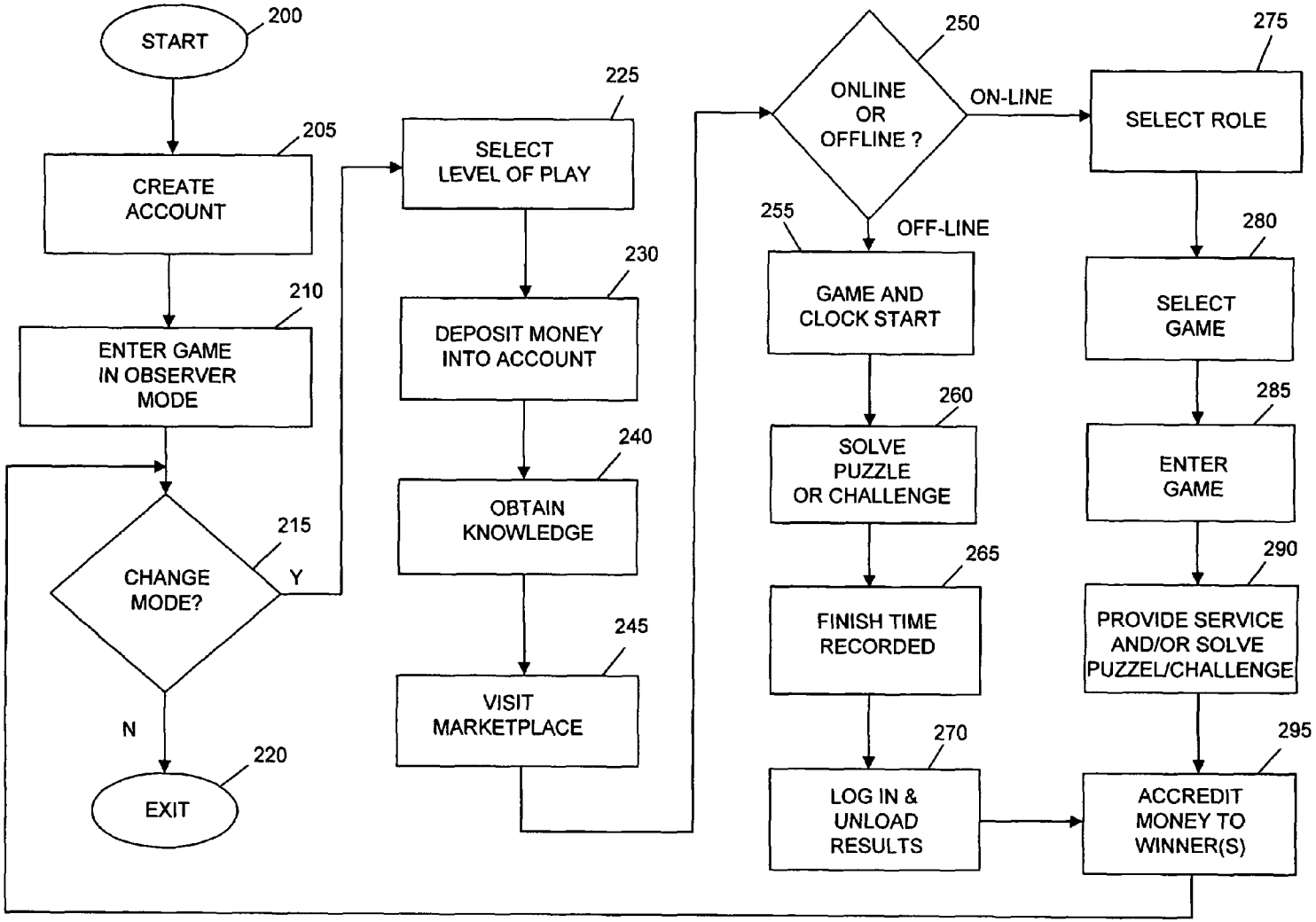
FIG. 2 is a flow chart of an embodiment showing steps of using the invention.
Figure 3:
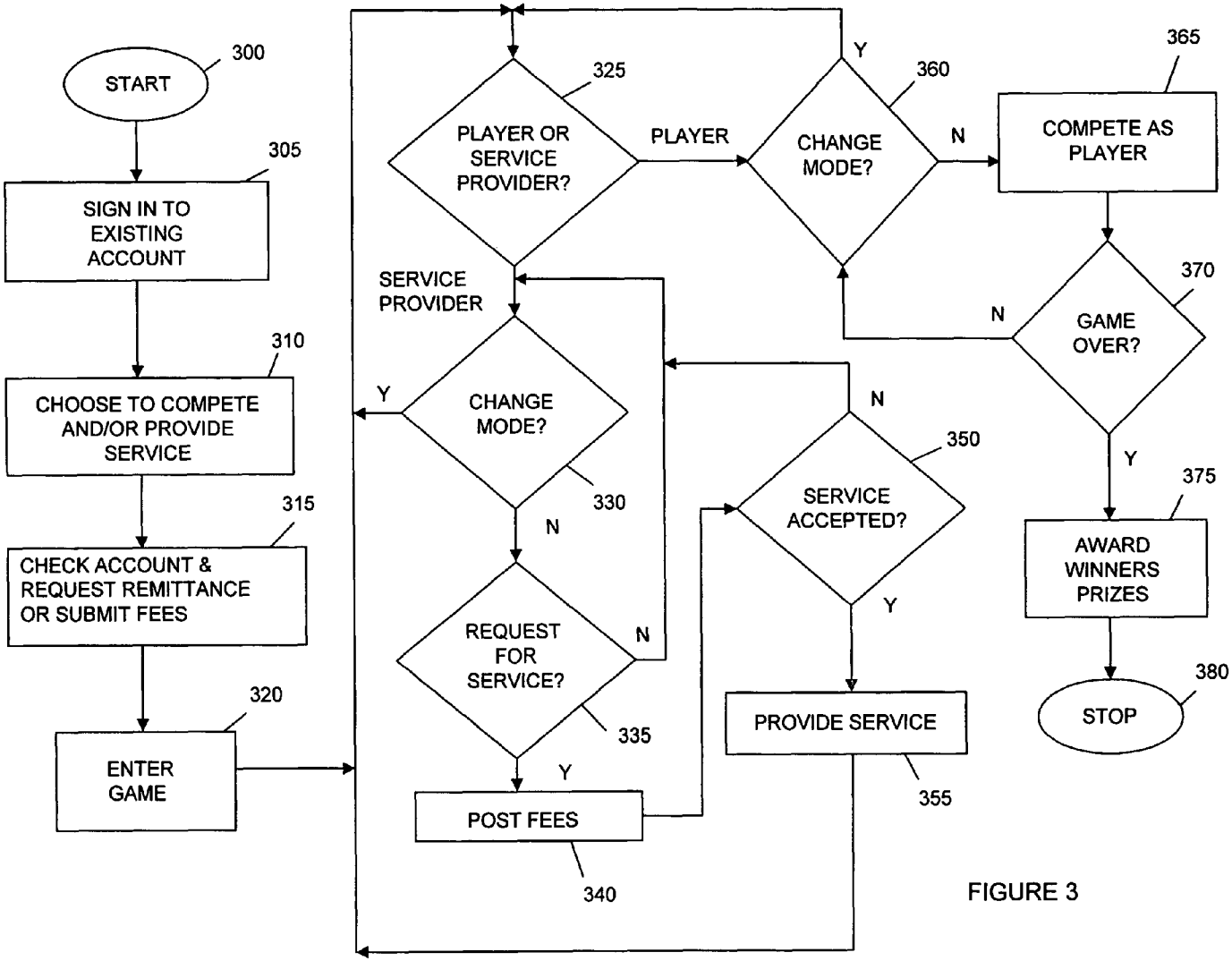
FIG. 3 is a flow chart of an embodiment showing steps of using the invention.

FIG. 2 is a flow chart of an embodiment showing steps of using the invention, starting at step 200. FIGS. 2 and 3 may equally represent a high-level block diagram of components of the invention implementing the steps thereof. The steps of FIGS. 2 and 3 may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). Additionally, the computer program code can be transferred to a workstation over the Internet or some other type of network. The steps of FIGS. 2 and 3 may be implemented using the embodiment of FIG. 1.

At step 205, an individual may access the game website and may create an account to begin their gaming adventures. At step 210, the individual, once an account has been set up, may enter a game in observer mode. In embodiments, the individual may have either free access for an unlimited amount of time, or the individual may pay fees according to the game chosen. The individual/player may be placed in an observer mode so they are restricted from spending (e.g., losing) money, but may not win money either.

At step 215, a check is made whether the individual/player has decided to change mode. That is, if the person does not want to continue in observer mode, the individual may have the option of removing their account and/or leaving the game. However, if the individual/player wishes to enter the game as a participant, the individual/player may change to participant mode. If the individual chooses not to enter as a participant, then the process ends at step 220.

However, if the individual chooses to become a participant, then at step 225, the player may choose a level of play. For example, the player may choose to play in a 1/1 conversion level, a 1/10 conversion level or 1/100 conversion level, or even a multiplier conversion rate of 2/1, or any other available level provided by the game provider. These levels typically correspond to a conversion rate at which the player's real money is converted. For example, an item in a game may cost thirty dollars ($30). In the 1/1 level, the player may be actually be spending thirty ($30) real dollars to purchase items in the game. However, if the player were playing in the 1/100 realm, then that same thirty-dollar ($30) item would only cost 30 cents. This scheme provides a level of separation between players; avoiding one group of players dominating everyone. In some games, however, there may be only one level.

At step 230, the player may deposit money into their account. This may be accomplished using a credit card, checking account number, or any other payment system like PayPal®. Once the player deposits an amount of money to their account, the game may recommend a minimum balance that a player should maintain in their account for game playing. At any time during game play or after game play, a player may add additional funds to their account, if necessary. Alternatively, synchronous payments may be made coinciding with purchases of items in the game, using a micropayment system as is now commonly available.

At step 240, a player may wish to pay to obtain knowledge. As is commonly encountered in many games, advancement in the skill level and competitiveness of the game may require special knowledge. Therefore, a player may pay to attend on-line education and pay for real-time fee based hints during game play. Typically, such education or hints would be "in character," however, other options may be available that are not "in character."

Education classes may nominally provide the character (i.e., the player) more information about the game and such knowledge may give the character capabilities and/or strengths. This ability to purchase education is significantly different than many of today's methods such as supplying a manual with everything a player needs to know at the time of purchase of the game. In this way, on-line purchasing of education induces a level of mystery of expectations and discoveries. The education may be applied so that the player pays for only the education (i.e., hints and tips) that is meaningful to the player. In this way, a player increases their odds of winning when they are well educated and well supplied.

At optional step 245, the player may visit a gaming marketplace. At the marketplace, the player may interact with other players or obtain directly from the marketplace items to sell or purchase such as clothes, protection, weapons, maps, books, transportation, or other such assets as appropriate for a particular game. The quality or quantity of these goods, and the effect upon the game's future direction, may correlate directly with the cost.

At step 250, a player may choose to play the game either on-line or off-line. If the player chooses to play off-line, then at step 255, the game is timed against other participants that chose to play the game off-line during the same start period. At step 260, a player plays the game off-line and solves the puzzle or challenge. During the play, the player may spend money to complete tasks or obtain items or services. These charges are updated to the player's account the next time the player logs into the system.

At step 265, when the user completes the game, a finish time is recorded and may be optionally saved. At step 270, the player, within a set period of time, for example, 24 or 48 hours, logs into the on-line game environment and may upload their experience. The charges incurred during the off-line game and the completion time may then be uploaded to the central game server. At step 295, at the end of the game time, a winner may be identified and any winning prize money may be credited to the winner's account. The process continues at step 215.

If at step 250, the player chooses to play the game on-line, then at step 275, the player may select a game role. A role may be either a service provider or an active participant. A player may take on different roles; that is, the player may play the game to win and make money, or the player may play the game to provide a service, such as for example, a bodyguard, which makes money by providing the bodyguard service to other players. Assuming a service provider role may provide a quick recharge of funds to resume playing the game and acquiring other assets or to buy a service provided by another service provider. In embodiments, a barter operation may take place where a service provider may swap services with another service provider for an agreed upon exchange rate, thus each player may gain new advantages by exchanging services for little or no cost.

When a player selects a service provider, the type of service provider is typically related to the nature of the game and would be "in character," as relevant to the game. Service providers, therefore, may make money by providing a special service to other players. Examples of these services include, but not limited to, a body guard that has gained education and weapons to be a strong fighter and may offer their protection services to another player for a fee. Other examples may include, a "hit man" to be hired by a player to eliminate other players, or a guide who may be an expert at the map of the game and may offer to guide other players through the maze or game at a faster rate. Further examples may include a medic to offer healing services to a wounded player or perhaps a trader that may buy assets from other players and sell those assets to other players for a profit. These examples are meant to be illustrative and not limiting and, accordingly, one of ordinary skill in the art would recognize that service providers may offer any type of service germane to a game.

A player may also choose to be an active participant in the game. However, in embodiments, a player may select to be an active participant while at the same time also serving as a service provider. In this mode, the player may suspend active play during those periods when the player's special service provider role is provided to another player. By switching to a service provider from an active participant, a player may typically sacrifice time towards winning the game. However, the financial tradeoffs should be weighed as part of the game by the player.

At step 280, the player may select a puzzle or challenge or game in which they wish to compete. At step 285, the player may enter the game as a service provider, active participant, or in embodiments, both service provider and active participant. At step 290, the player enters the game and provides a service or plays the game as an active participant. As an active participant, the player competes to solve a puzzle, win a challenge or finish a game. If the player chooses to enter the game as a service provider, a player may take on various roles, such as for example, a medical offering to heal wounded players for a fee or to act as a bodyguard to fight off attackers of another player.

At step 295, a winner or winners may have money accredited to their accounts according to the level of play and rewards as published by the gaming entity. The process then continues at step 215.

FIG. 3 is a flow chart of an embodiment showing steps of using the invention beginning at step 300. At step 305, a player may sign-in to an existing account on the game provider's website. At step 310, the player may choose to compete as a player in a game or challenge and/or choose to provide a service to another player, such as for example, a medic or a bodyguard.

At step 315, the players may check their account to establish whether they must submit fees or, if they have significant winnings, may request a remittance of money for their own use. At step 320, the player may enter the game as a service provider or as a player. At step 325, a check is made to determine whether the player entered as an active player or a service provider. If a service provider, then at step 330, a check is made to see if the player has opted to change the mode of play from service provide to active player. If no change in mode is made, then at step 335, a check is made to see if another player has made a request for a service as provided by this service provider. If no request has been made by another player, then processing continues with step 330.

If however, a request has been made by another player for this service provided by this service provider, then at step 340, the service provider may post fees for his service. At step 350, a check is made to determine whether the request for service has been accepted based upon posted fees. This allows multiple service providers to compete for providing a service and keeps fees for a particular service at an optimal level (i.e., on a competitive fee basis), thus establishing, in effect, a competitive free market scenario among service providers and service seekers. In embodiments, an auction or bid process may be provided for acquiring a competitive service from competing service providers. If the service has been accepted, then at step 355, the service provider provides a service in accordance with the offered role. An account entry may be entered to assess a fee by debiting an account of the player receiving the service and crediting the account of the service provider. The processing continues at step 325. If however, at step 350, the service is not accepted, then processing continues at step 330.

If at step 325, the player had previously selected to play a game as an active player, then at step 360, a check is made to see if the active player has now requested to change mode of playing. If the player has selected to change mode, then the mode is changed from active player to service provider and processing continues at step 325. If, however, a change of mode has not been requested by the active player, then processing continues at step 365. At 365, the active player competes in the challenge, game, or puzzle. A player may make money, for example, by finding assets in the game, first to find a treasure, or first to reach objectives. Money/credit (e.g., an account entry) may be granted to other participants based on performance or game criteria.

At step 370, a check is made to see if the game is over. This may be in accordance with a time-out or when a player achieves a goal. If the game is not over, then the processing continues at step 360. If however, the game is over, then at step 375, winners may be awarded any prizes which may include monetary awards. This may be accomplished by accrediting the awards monies to the winner's account. In embodiments, service providers may also receive credit. Processing then completes at step 380.

Examples of Game Creation and Game Play

A new storyline (i.e., challenge) adventure, or treasure hunt may be created every day, or on a regular basis, by the gaming company in order to keep the game unique. This may include randomly generated options from a database of actions. A player may play the same challenge over and over until they win.

Players may also create their own challenges or puzzles. The service provider hosting the game may optionally pay the creator of a challenge or puzzle a small fee for the creation and hosting of the puzzle or challenge on their main computer system. Depending on demand, games may start every few minutes or every hour or on some predetermined interval. The prize or treasure awarded to winners may be a percentage of collections for any particular game. The hosting game company may keep a percentage for operations and profit. A game may also optionally allow for teams of players and the winning team may split the winnings appropriately.

In certain games, a service provider may be available for a fee. By way of illustration, a player could conceivably be wounded, and require medical care. In this scenario, the service provider would be a medic that provides a medical service and earns money in this fashion. As another example, weather may become relevant in a game. For a fee, a player may speak with a weather forecaster prior to specific weather-sensitive activities. In this way, a player may increase their advantage during the game by acquiring weather knowledge.

Game timelines may be variable. For example, five minutes of real time may equate to one hour of game time. This may also allow for day time and night time play in the game.

While the invention has been described in terms of embodiments, those skilled in the art will recognize that the invention can be practiced with modifications and in the spirit and scope of the appended claims.

What is claimed is:

1. A method of gaming on a computing device, comprising the steps of:

participating in a game using the computing device by selecting one or more game roles and selecting a conversion rate or a multiplier conversion rate selected from a plurality of conversion rates or a plurality of multiplier conversion rates, wherein the conversion rate or the multiplier conversion rate is based on a conversion rate of virtual currency to real currency; and accumulating an account entry in an account of a user based upon the selected one or more game roles and accompanying activity, wherein at least one of the one or more game roles is a service provider which provides a service within a gaming environment to an active player playing the game.

2. The method of claim 1, wherein the one or more game roles comprises two or more game roles and at least one of the two or more game roles is the active player.

3. The method of claim 1, wherein the accumulating step includes transacting a monetary debit in the user account.

4. The method of claim 1, wherein the accumulating step includes transacting a monetary credit in the user account.

5. The method of claim 1, further comprising participating in one of an on-line mode and an off-line mode.

6. The method of claim 5, further comprising reconciling the account when the user logs in after participating in the off-line mode.

7. The method of claim 1, wherein the user selects more than one role of the one or more roles.

8. The method of claim 1, further comprising selecting a different role of the one or more roles.

9. The method of claim 1, further comprising charging an initial fee upon participating.

10. The method of claim 1, wherein the accumulating is based on achieving a goal or providing a requested service to another game participant.

11. The method of claim 1, wherein the selected one or more game roles include the service provider that provides a service in one of an in-character and an out-of-character role, according to the game.

12. The method of claim 1, further comprising the steps of:

posting one or more fee associated with a service;

accepting the service based on the one or more fees; and crediting an account of the service provider based on the accepted service.

13. The method of claim 1, wherein the accompanying activity includes at least any one of achieving a goal, winning a prize, winning the game, providing a service and solving a puzzle.

14. The method of claim 1, wherein:

the accompanying activity comprises the service provided by the service provider; and the account entry records an entry based on virtual currency received for the accompanying activity associated with the game and the account entry is converted to a different rate according to the conversion rate or the multiplier conversion rate selected.

15. The method of claim 14, further comprising requesting remittance of accumulated credit comprising the account entry from the account payable to the user in the real world currency.

16. A system for gaming, comprising:

a means for participating in a game by selecting one or more game roles and selecting a conversion rate or a multiplier conversion rate selected from a plurality of conversion rates or a plurality of multiplier conversion rates, wherein the conversion rate or the multiplier conversion rate is based on a conversion rate of virtual currency to real currency; and a means for accumulating an account entry in an account of a user based upon the selected one or more game roles and accompanying activity, wherein at least one of the one or more game roles is a service provider which provides a service within a gaming environment to an active player playing the game.

17. The system of claim 16, wherein the one or more game roles comprises two or more game roles and at least one of the two or more game roles is the active player.

18. The system of claim 16, further comprising a means for transacting a monetary debit in the user account and a means for transacting a monetary credit in the user account.

19. The system of claim 16, wherein the means for participating includes one of an on-line mode and an off-line mode.

20. The system of claim 16, further comprising a means for reconciling the account when the user logs in after participating in the off-line mode.

21. The system of claim 16, further comprising a means for the user to select more than one role of the one or more roles and for selecting a different role of the one or more roles.

22. The system of claim 16, further comprising a means for charging an initial fee upon participating.

23. A system of claim 16, wherein the means for accumulating provides for accumulating based on achieving a goal or providing a requested service to another game participant.

24. The system of claim 16, further comprising:

a means for posting the one or more fees associated with a service;

a means for accepting the service based on the one or more fees; and a means for crediting an account of the service provider based on the accepted service.

25. The system of claim 16, wherein the accompanying activities include at least any one of achieving a goal, winning a prize, winning the game, providing a service and solving a puzzle.

26. The system of claim 16, wherein;

the accompanying activity comprises the service provided by the service provider; and the account entry records an entry based on virtual currency received for the accompanying activity associated with the game and the account entry is converted to a different rate according to the conversion rate or the multiplier conversion rate selected.

27. A computer program product comprising a computer usable medium having readable program code embodied in the medium, the computer program product includes at least one component to:

participate in a game by selecting two or more game roles and selecting a conversion rate or a multiplier conversion rate selected from a plurality of conversion rates or a plurality of multiplier conversion rates, wherein the conversion rate or the multiplier conversion rate is based on a conversion rate of virtual currency to real currency;

participate in on-line real-time fee based education in the game regarding an aspect of the game, wherein the education is supplemental to any education obtainable by playing the game;

accumulate an account entry in an account of a user based upon the selected one or more game roles and accompanying activity;

wherein:

the two or more game roles comprise:

an active player that participates in the game by completing tasks assigned by the game, a service provider that provides a service within the game to an active player playing the game, and the service provider posts, within the gaming environment, one or more fees associated with the service provided to the active player playing the game, the accompanying activity comprises the tasks completed by the active player and the service provided by the service provider, and the account entry records an entry based on virtual currency received for the accompanying activity associated with the game and the account entry is converted to a different rate according to the conversion rate or the multiplier conversion rate selected; and provide remittance of accumulated credit comprising the account entry from the account payable to the user in the real currency.

* * * * *